US010234095B2

(12) United States Patent
Chiu

(10) Patent No.: US 10,234,095 B2
(45) Date of Patent: Mar. 19, 2019

(54) LENS AND VEHICLE HEADLAMP STRUCTURE

(71) Applicant: MiiCs & Partners (Shenzhen) Co., Ltd., Shenzhen (CN)

(72) Inventor: Po-Chin Chiu, New Taipei (TW)

(73) Assignee: MiiCs & Partners (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 15/426,139

(22) Filed: Feb. 7, 2017

(65) Prior Publication Data

US 2017/0343176 A1 Nov. 30, 2017

(30) Foreign Application Priority Data

May 28, 2016 (TW) ..... 105116782 A

(51) Int. Cl.

*F21S 41/20* (2018.01)
*F21S 41/24* (2018.01)
*F21S 41/32* (2018.01)
*F21S 41/275* (2018.01)

(52) U.S. Cl.

CPC ..... *F21S 41/285* (2018.01); *F21S 41/24* (2018.01); *F21S 41/275* (2018.01); *F21S 41/322* (2018.01)

(58) Field of Classification Search

CPC ..... F21S 41/24; F21S 41/275; F21S 41/285; F21S 41/322; F21S 48/1283
USPC ..... 362/327, 245, 309, 336
See application file for complete search history.

(56) References Cited

U.S. PATENT DOCUMENTS 5,813,743 A * 9/1998 Naka ..... F21V 5/02 362/16
6,819,505 B1 * 11/2004 Cassarly ..... F21L 4/027 359/708
6,924,943 B2 * 8/2005 Minano ..... G02B 3/08 359/720
7,731,388 B2 * 6/2010 Hoelen ..... F21S 10/02 362/231
8,403,530 B2 * 3/2013 Singer ..... F21V 7/0025 362/240
8,562,191 B2 * 10/2013 Okada ..... F21S 48/215 362/309
8,576,406 B1 * 11/2013 Jannson ..... F21V 13/04 356/496
8,733,992 B2 * 5/2014 Bushre ..... B60Q 1/20 362/520
8,740,417 B2 * 6/2014 Jiang ..... F21V 5/04 362/296.05
D719,700 S * 12/2014 Chou ..... D26/120
9,128,344 B2 * 9/2015 Chen ..... G02F 1/153
(Continued)

*Primary Examiner* — Tsion Tumebo
(74) *Attorney, Agent, or Firm* — ScienBiziP, P.C.

(57) ABSTRACT

A vehicle headlamp structure free of reflective internal elements includes a lens and a light source. The lens includes a light emitting surface, a bottom surface, and a connecting surface. The light emitting surface is flat and the bottom surface includes at least one depression in the bottom surface to form at least one light incident structure. The at least one light incident structure includes a first light incident surface. The connecting surface is composed of a plurality of curved surfaces each with a different radius of curvature. The light source is substantially accommodated within the light incident structure and emits light through the first light incident surface to form an elliptical beam.

16 Claims, 5 Drawing Sheets

(56) References Cited

U.S. PATENT DOCUMENTS

| | | | | |
|---|---|---|---|---|
| 9,234,644 | B2 * | 1/2016 | Ebner | F21V 5/007 |
| 9,464,768 | B2 * | 10/2016 | Stein | F21S 43/315 |
| D771,172 | S * | 11/2016 | Huang | D16/134 |
| D771,304 | S * | 11/2016 | Goltche | D26/120 |
| D775,407 | S * | 12/2016 | Datz | D26/122 |
| 2004/0264196 | A1 * | 12/2004 | Shu | F21V 5/04 362/294 |
| 2007/0086204 | A1 * | 4/2007 | Chinniah | F21V 5/04 362/520 |
| 2008/0043466 | A1 * | 2/2008 | Chakmakjian | F21V 5/007 362/237 |
| 2009/0046468 | A1 * | 2/2009 | Wang | F21V 7/09 362/297 |
| 2010/0284194 | A1 * | 11/2010 | Miyashita | F21V 5/04 362/311.09 |
| 2014/0001507 | A1 * | 1/2014 | Streppel | F21V 5/002 257/98 |
| 2014/0204588 | A1 * | 7/2014 | Ha | F21K 9/50 362/308 |

* cited by examiner

LENS AND VEHICLE HEADLAMP STRUCTURE

FIELD

The subject matter herein generally relates to vehicle lighting.

BACKGROUND

In the field of automotive headlamp applications, a lens for a vehicle headlamp is used to control a light distribution of the headlamp and to meet automotive lighting regulations.

BRIEF DESCRIPTION OF THE DRAWINGS

Implementations of the present technology will now be described, by way of example only, with reference to the attached figures.

DETAILED DESCRIPTION

Figure 1:
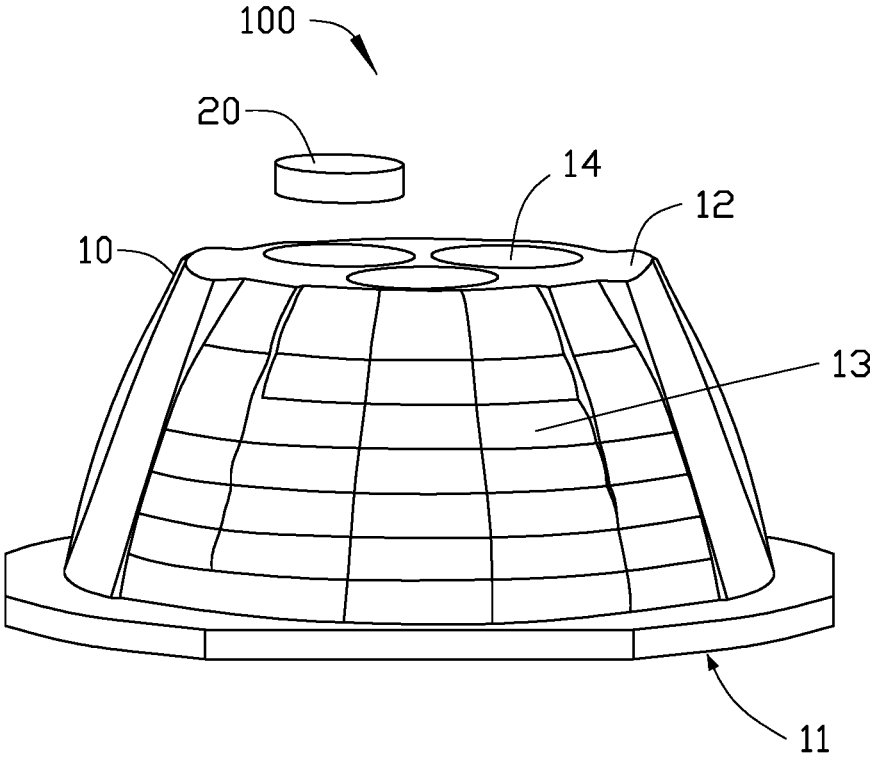
FIG. 1 is a diagrammatic perspective view of an exemplary embodiment of a headlamp structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

Figure 2:
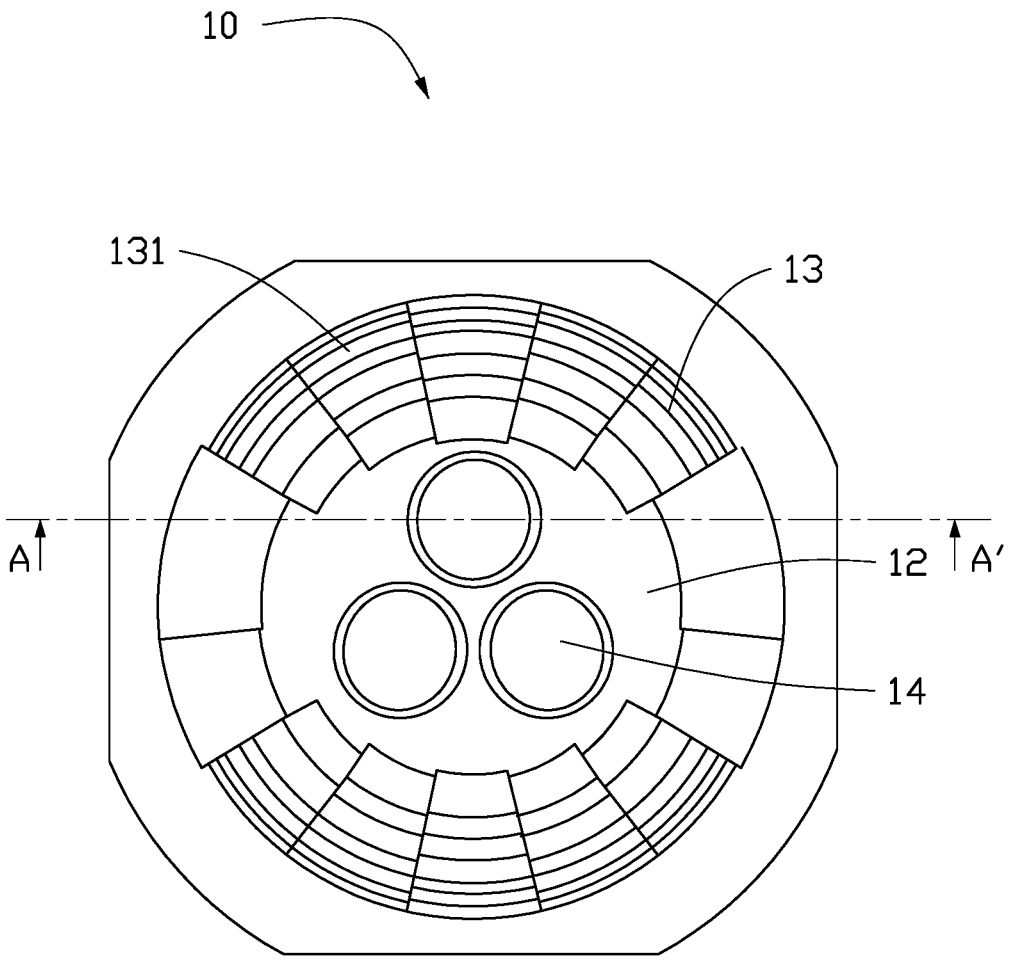
FIG. 2 is a diagrammatic view of the interior of a lens of the headlamp structure of FIG. 1, looking from a bottom surface to a light emitting surface.
Figure 3:
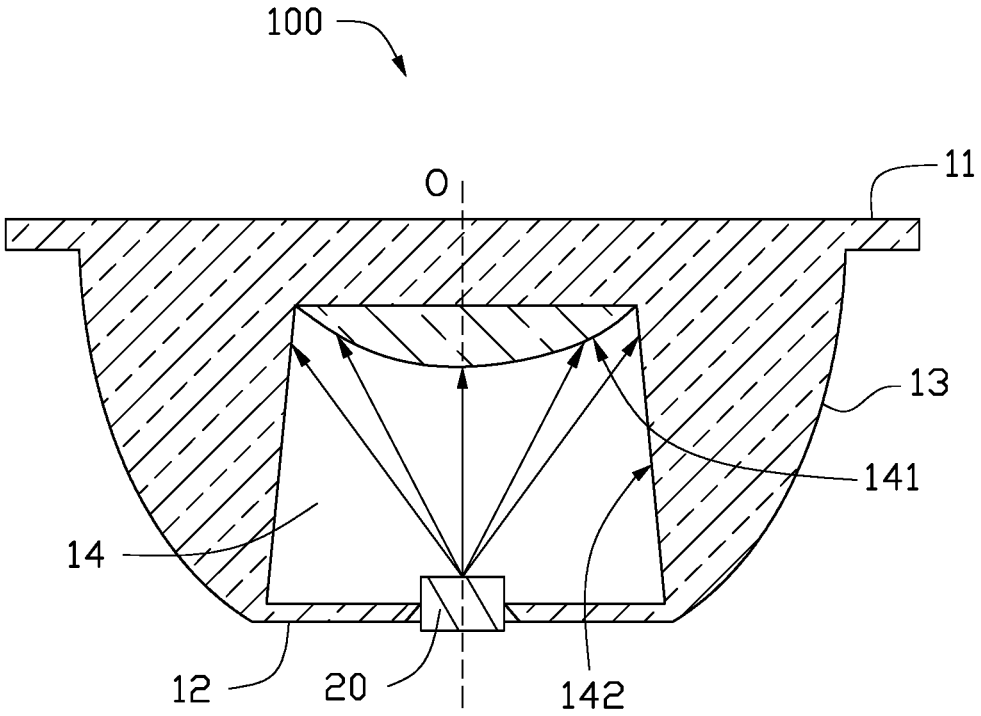
FIG. 3 is a diagrammatic cross-sectional view of the lens of the headlamp structure in FIG. 1 according to the present disclosure, along a line of A-A' of FIG. 2.

FIGS. 1 to 3 illustrate a headlamp structure 100 including a lens 10 and at least one light source 20 accommodated within the lens 10.

FIG. 1 further illustrates that the lens 10 includes a light emitting surface 11, a bottom surface 12 facing away from the light emitting surface 11, and a connecting surface 13 connecting the light emitting surface 11 and the bottom surface 12.

FIG. 2 illustrates the lens 10 seen from the bottom surface 12 to the light emitting surface 11. In at least one embodiment, the circumference of the light emitting surface 11 has a substantially elliptical shape, as shown in FIG. 1, and the surface is flat. In other embodiments, the circumference of the light emitting surface 11 can be an octagonal shape or a polygonal shape as shown in FIG. 2.

In at least one embodiment, the circumference of the bottom surface 12 is substantially elliptical-shaped, as shown in FIG. 2. In other embodiments, the circumference of the bottom surface 12 can be rectangular-shaped. The bottom surface 12 has a surface area less than the surface area of the light emitting surface 11. In at least one embodiment, the bottom surface 12 of the lens 10 is fixed to a vehicle body or a vehicle headlamp housing. The bottom surface 12 further includes at least one depression to form at least one light incident structure 14 that is recessed from the bottom surface 12, as shown in FIG. 1 and FIG. 2.

FIG. 3 illustrates a cross section of the headlamp structure 100 along a line of A-A' in FIG. 2. The portion of the headlamp structure 100 shown in FIG. 3 includes the light source 20 and a portion of the lens 10 adjacent to the at least one light incident structure 14. The at least one light incident structure 14 includes a first light incident surface 141 and a second light incident surfaces 142. The second light incident surface 142 connects the bottom surface 12 and the first light incident surface 141.

The light source 20 emits light with a central axis O as shown in FIG. 3. The light source 20 is partially accommodated in the at least one light incident structure 14. In at least one embodiment, a bottom of the light source 20 is substantially flush with the bottom surface 12 of the lens 10. In other embodiments, the light source 20 can protrude from the bottom surface 12 outside of the lens 10 as shown in FIG. 3. Since the light emitting surface 11 is flat and is substantially elliptical-shaped in circumference, the light which is emitted from the light source 20 forms substantially an elliptical-shaped beam.

The connecting surface 13 is composed of a plurality of curved surfaces with different radii of curvature. The curved surfaces are continuously connected and located between the bottom surface 12 and the light emitting surface 11. The number of the curved surfaces and the radius of curvature for each of the plurality of curved surfaces can be arranged so that incident light falling on a curved surface is reflected to a specific direction so that the light emitting distribution of the headlamp structure 100 can conform to the automotive headlight regulations.

In at least one embodiment, the connecting surface 13 is a totally reflective surface. In other embodiments, the connecting surface can be a translucent surface with a high reflectivity. The connecting surface 13 is composed of a plurality of curved surfaces with different radii of curvature and the thicknesses of the lens 10 corresponding to different curved surfaces are different. The different surfaces with different radii of curvature thus give the surface profile of the bottom surface 12 a jagged shape, as shown in FIG. 2. In other embodiments, the surface profile of the bottom surface 12 can be substantially elliptical-shaped.

In at least one embodiment, each of the curved surfaces of the connecting surface 13 further include a plurality of microstructures 131 as shown in FIG. 2. The microstructure 131 can enhance the surface strength of the lens 10 and increase the reflectivity for each of the curved surfaces of the connecting surface 13. In at least one embodiment, the microstructure 131 can be any of a mesh, a grid, and a texture. The microstructure 131 can be a photonic crystal structure or a three dimensional grating matrix.

The at least one light incident structure 14 is formed by recessing the bottom surface 12 toward the light emitting surface 11. As shown in FIG. 3, the light source 20 is accommodated within the at least one light incident structure 14 formed by the first light incident surface 141 and the second light incident surface 142. The first light incident surface 141 is located at the top of the light incident structure 14 away from the bottom surface 12. The second light incident surface 142 is located at a sidewall of the light incident structure 14 and faces away from the connecting surface 13.

FIG. 3 further illustrates that the cross section of the light incident surface 141 is a curved surface. The first light incident surface 141 projects toward the bottom surface 12.

Figure 4:
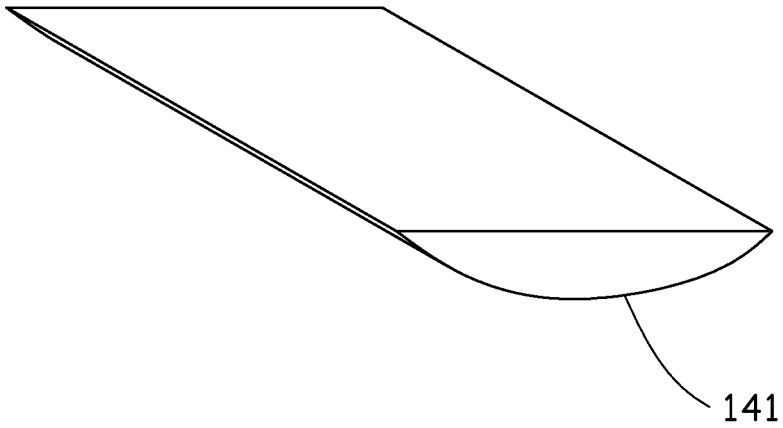
FIG. 4 is a diagrammatic perspective view of a D-shaped curved surface of the lens of the headlamp structure in FIG. 3.

FIG. 4 illustrates part of the lens 10 adjacent to the first light incident surface 141 with a uniformly curved shape. The part of the lens 10 which is illustrated has the sectional shape of a "D." In other embodiments, the shape or structure of the lens 10 is such that the first light incident surface 141 can form a semi-circle. The light emitted from the light source 20 is output as an elliptically light spot after passing through the first light incident surface 141 and the second light incident surface 142.

In at least one embodiment, the light incident structure 14 is a light-receiving element, in the shape of a round hole or a slot. In at least one embodiment, the second light incident surface 142 is slanted from the light central axis O of the light source 20 and the light incident structure 14, as shown in FIG. 3. The width of the cross section of the light incident structure 14 from the first light incident surface 141 toward the bottom surface 12 gradually increases.

In at least one embodiment, the bottom surface 12 has three light incident structures 14. Each of the three light incident structures 14 is round and located on the bottom surface 12 as shown in FIG. 2. In addition, the centers of the three light incident structures 14 in FIG. 2 form an equilateral triangle. In other embodiments, the number of light incident structures 14 is not limited to three, and the number of the light incident structures 14 can be determined according to the actual requirements.

A light source 20 is accommodated within at least one of the light incident structures 14. The light source 20 can be a bulb, a high intensity discharge (HID) lamp, a light emitting diode, a laser diode, or the like. In at least one embodiment, the light source 20 is a light emitting diode. In other embodiments, the light source 20 can be an LED array, a light bar, or a light engine. With a greater number of the light sources 20, the overall optical power of the headlamp structure 100 is higher. In at least one embodiment, the number of the light sources 20 is three, and a light source 20 is accommodated within each of the three light incident structures 14. In other embodiments, the number of the light sources 20 is not limited to three, and the specific number thereof can be determined according to actual need.

Figure 5:
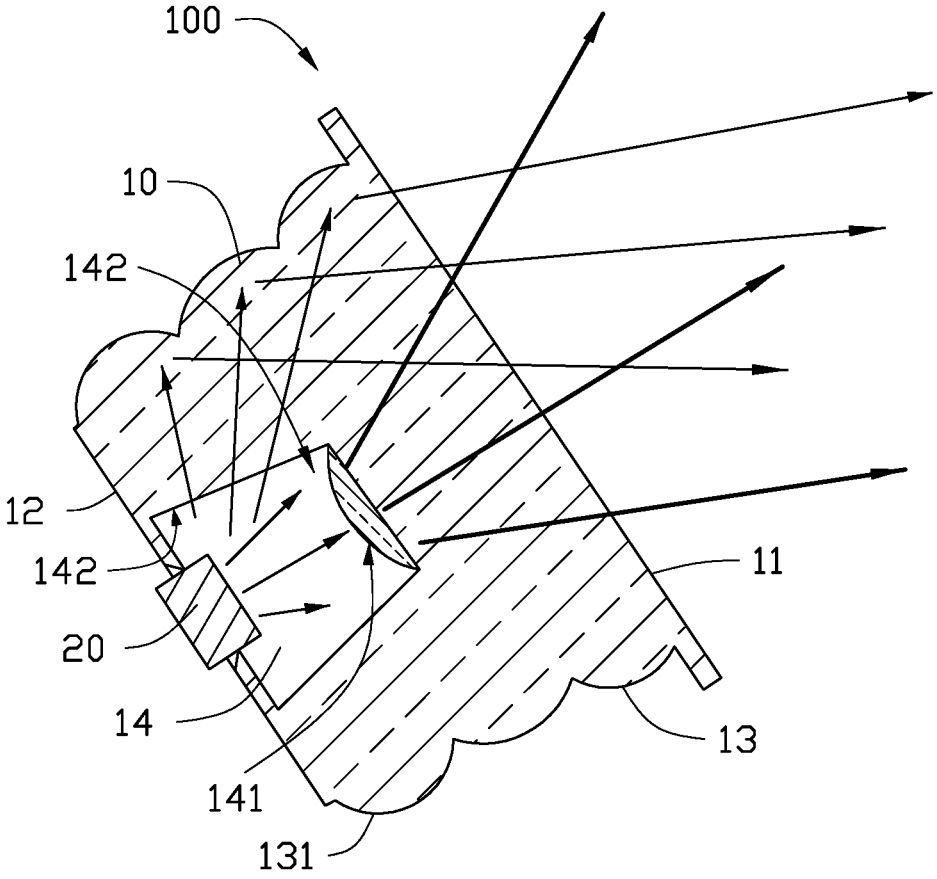
FIG. 5 is a diagrammatic view of light distribution of the headlamp structure in FIG. 1.

FIG. 5 shows the light distribution of the headlamp structure 100. A portion of the light emitted from the light source 20 enters the lens 10 through the first light incident surface 141 and directly passes through the light emitting surface 11. The remaining portion of the light enters the lens 10 through the second light incident surface 142. All light falls as incident light onto the connecting surfaces 13 which have different radii of curvature. The light is totally reflected to the light emitting surface 11. Finally, all of the light emitted from the light emitting surface 11 is combined to represent the total light distribution of the headlamp structure 100.

This disclosure provides a lens and a headlamp structure having the lens. The lens includes a connecting surface, a bottom surface, and a light emitting surface. The connecting surface includes a plurality of curved surfaces with different radii of curvature and incident light is totally reflected. The bottom surface includes a light incident structure with a first light incident surface away from the bottom surface. The light emitting surface includes a flat surface which outputs the light. The headlamp structure includes the lens and a light source to output a light distribution conforming to the automotive headlight regulations. The lens and the headlight structure of the present disclosure do not require an additional reflecting mirror to reflect light from a region above a cut-off line to different regions for matching automotive headlamp regulations. The lens and the headlamp structure of the disclosure reduce the cost of the vehicle headlamp and increase the utilization of light.

The embodiments shown and described above are only examples. Many details are often found in the art such as the other features of a lens and a headlamp structure. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A lens comprising:

a light emitting surface, the light emitting surface is a flat surface;

a bottom surface facing away from the light emitting surface, the bottom surface comprises at least one depression from the bottom surface to form at least one light incident structure with a first light incident surface that is recessed from the bottom surface; and a connecting surface connecting the light emitting surface and the bottom surface, the connecting surface is a total reflection surface composed of a plurality of curved surfaces with different radii of curvature, wherein the first light incident surface of the at least one light incident structure projecting toward the bottom surface is a D-shaped curved surface, the light incident structure further comprises a second light incident surface located on a sidewall of the light incident structure, the second light incident surface faces away from the connecting surface for connecting the bottom surface and the first light incident surface, the bottom surface bends into the light incident structure and further extends horizontally to connect the second light incident surface, a width of a cross section of the light incident structure from the first light incident surface toward the bottom surface is linearly increased.

2. The lens of claim 1, wherein the light emitting surface is elliptical-shaped.

3. The lens of claim 1, wherein the light emitting surface is rectangular-shaped.

4. The lens of claim 1, wherein the bottom surface has a surface area less than the surface area of the light emitting surface.

5. The lens of claim 1, wherein the curved surfaces with different radii of curvature are located between the bottom surface and the light emitting surface, and each of the cured surfaces with different radii of curvature comprises a plurality of microstructures.

6. The lens of claim 1, wherein the microstructure is one or more of a mesh, a grid, and a texture.

7. The lens of claim 1, wherein the D-shaped curved surface is semi cylindrical-shaped.

8. The lens of claim 1, the bottom surface is substantially elliptical-shaped.

9. A headlamp structure comprising:

a lens comprising a light emitting surface, the light emitting surface is a flat surface;

a bottom surface facing away from the light emitting surface, the bottom surface comprises at least one depression from the bottom surface to form at least one light incident structure with a first light incident surface that is recessed from the bottom surface; and a connecting surface connecting the light emitting surface and the bottom surface, the connecting surface is a total reflection surface composed of a plurality of curved surfaces with different radii of curvature; and at least one light source accommodated within the light incident structure, wherein the first light incident surface of the at least one light incident structure projecting toward the bottom surface is a D-shaped curved surface, the light incident structure further comprises a second light incident surface located on a sidewall of the light incident structure, the second light incident surface faces away from the connecting surface for connecting the bottom surface and the first light incident surface, the bottom surface bends into the light incident structure and further extends 5 horizontally to connect the second light incident surface, a width of a cross-section of the light incident structure from the first light incident surface toward the bottom surface is linearly increased.

10. The headlamp structure of claim 9, wherein the light emitting surface is elliptical-shaped.

11. The headlamp structure of claim 9, wherein the light emitting surface is rectangular-shaped.

12. The headlamp structure of claim 9, wherein the bottom surface has a surface area less than the surface area of the light emitting surface.

13. The headlamp structure of claim 9, wherein the curved surfaces with different radii of curvature are located between the bottom surface and the light emitting surface, and each of the cured surfaces with different radii of curvature comprises a plurality of microstructures.

14. The headlamp structure of claim 9, wherein the microstructure is one or more of a mesh, a grid, and a texture.

15. The headlamp structure of claim 9, wherein the D-shaped curved surface is semi cylindrical-shaped.

16. The headlamp structure of claim 9, the bottom surface is substantially elliptical-shaped.

* * * * *